US006324710B1

(12) United States Patent
Hernandez et al.

(10) Patent No.: US 6,324,710 B1
(45) Date of Patent: Dec. 4, 2001

(54) PRONE SUPPORT APPARATUS FOR SPINAL PROCEDURES

(76) Inventors: Arthur S. Hernandez; Maria Christina G. Herrera, both of 8418 Northview Pass, Fair Oaks Ranch, TX (US) 78015

( * ) Notice: Subject to any disclaimer, the term of this patent is extended or adjusted under 35 U.S.C. 154(b) by 0 days.

(21) Appl. No.: 09/551,975

(22) Filed: Apr. 14, 2000

(51) Int. Cl.[7] ..... A61G 7/65

(52) U.S. Cl. ..... 5/630; 5/632; 5/639; 5/652

(58) Field of Search ..... 5/630, 632, 633, 5/636, 637, 639, 640, 733, 652, 900.5, 648; 128/845, 870, 871; 600/240

(56) References Cited

U.S. PATENT DOCUMENTS

| | | | | |
|---|---|---|---|---|
| 2,521,530 | * | 9/1950 | McGuffage | 5/630 |
| 4,398,707 | | 8/1983 | Cloward . | |
| 4,579,111 | * | 4/1986 | Ledesma | 128/870 |
| 4,665,573 | | 5/1987 | Fiore . | |
| 4,840,362 | | 6/1989 | Bremer et al. . | |
| 5,012,539 | * | 5/1991 | Grigg | 5/648 |
| 5,014,375 | | 5/1991 | Coonrad et al. . | |
| 5,131,106 | | 7/1992 | Jackson . | |
| 5,239,716 | | 8/1993 | Fisk . | |
| 5,245,719 | | 9/1993 | Ott . | |
| 5,279,310 | * | 1/1994 | Hsien | 5/648 |
| 5,482,355 | * | 1/1996 | Franzen, Jr. | 606/240 |
| 5,584,302 | | 12/1996 | Sillaway et al. . | |
| 5,613,254 | | 3/1997 | Clayman et al. . | |
| 5,893,183 | * | 4/1999 | Bechtold, Jr. | 5/632 |
| 5,987,675 | * | 11/1999 | Kim | 5/632 |
| 6,154,903 | * | 12/2000 | Wai-Chung | 5/632 |

* cited by examiner

*Primary Examiner*—Michael F. Trettel
(74) *Attorney, Agent, or Firm*—Akin, Gump, Strauss, Hauer & Feld, LLP

(57) ABSTRACT

The present invention relates to a patient support device specifically designed to facilitate punctures and injections into the cervical (neck) or lumbar spine (lower back). The cushion support device provided by this invention has a raised V-shaped support cushion surface and a raised and rounded transverse cushion at one end for supporting a patient reposing therein in a facedown (prone) position and resisting lateral movement or rotation by that patient and reducing the lordosis (natural inward curve) of the lumbar spine or alternatively maximizing the flexion of the cervical spine.

10 Claims, 5 Drawing Sheets

PRONE SUPPORT APPARATUS FOR SPINAL PROCEDURES

FIELD OF THE INVENTION

The invention relates generally to apparatuses and techniques designed and used to hold a person in a face-down or prone position and eliminate the inward curve or lordosis of the lumbar spine or allow maximum flexion of the cervical spine, and more particularly for the purpose of providing optimum conditions for a practitioner such as a surgeon or pain specialist to perform an injection into the neck or lower back.

BACKGROUND OF THE INVENTION

This invention is concerned with improving the support systems currently available to physicians such as practicing pain management specialists wishing to perform a spinal or epidural tap, puncture or injection into the cervical or lumbar portions of the spine of a human being. In particular, this invention is concerned with minimizing lumbar lordosis, or alternatively, maximizing cervical flexion, to facilitate spinal and epidural taps, punctures, and injections.

The spinal column of a human being includes 33 bony segments called vertebrae, 24 of which are flexible. The flexible part of the spinal column includes 7 cervical vertebrae in the neck, 12 thoracic vertebrae at the back of the chest, and 5 lumbar vertebrae in the lower back. Each vertebra has a roughly cylindrical ventral part called the body, connected to which is a dorsal portion called the vertebral arch having multiple wing-like projections called spinous processes. The body and vertebral arch define a space through which the spinal cord passes. Between the bodies of adjacent vertebrae lie soft, round intervertebral disks of fibrocartilage. Numerous ligaments also connect the arches of adjacent vertebrae. The cervical, thoracic, and lumbar regions of the spine are each associated with a characteristic curve of the spine.

A spinal tap or puncture may be performed for diagnostic or therapeutic purposes. In such a procedure, a device such as a needle is inserted through the soft tissue enmeshed with and between the vertebrae of the spinal column and into the spinal canal at any appropriate level (cervical, thoracic, lumbar, or lumbo-sacral regions). In diagnostic procedures, spinal fluid can be withdrawn for study, or an injectable dye, radio-isotope tagged material, or other suitable agent may be injected to facilitate diagnostic procedures such as radiography. In therapeutic procedures, an appropriate substance can be injected into the canal. Examples of such injectable substances include pain medication (analgesics) such as narcotics, anesthetics such as lidocaine, and corticosteroids.

An epidural puncture (cervical, thoracic, lumbar, or lumbo-sacral) is similar to a spinal puncture except that the needle's target is the epidural space instead of the intrathecal space. The intrathecal space, like the epidural space, lies in the spinal canal. The intrathecal space lies deeper than the epidural space in the spinal canal, is surrounded by a thick membrane, the dura, and contains the spinal cord and cerebral spinal fluid. The epidural space is outside, or superficial to, the intrathecal space, and is the space wherein all the nerves of the spine lie just before being distributed to the arms, legs, or trunk. This space and the intrathecal space are essentially separated by the meninges.

A spinal puncture may be performed by a practitioner for a variety of reasons, including diagnostic and therapeutic measures. Some indications to perform a diagnostic puncture include clinical suspicion of meningitis or of certain diseases such as systemic lupus erythromatosis, sarcoidosis and multiple sclerosis. Therapeutic indications for spinal and epidural punctures include alleviation of pain such as pain associated with nerve root compression syndromes often accompanying vertebral disk disease.

The choices of anesthetic agents, steroids, dyes and the like for appropriate cases are within the knowledge of one of ordinary skill in the art. Similarly, the practitioner would be familiar with the choices of punctures, such as intrathecal or epidural punctures at various vertebral levels (cervical, thoracic, lumbar and sacral). The present invention is useful for all of these types of procedures.

To enhance the success of procedures that require an epidural or spinal puncture, the patient should lie in a prone position with the body not tilted to either the right or left. Moreover, it is important to flex the portion of the spinal region being treated to make it easier to negotiate the needle between the many winglike projections of the vertebrae's vertical arches and into the epidural space of the spine.

For a lumbar puncture, the natural concave curve, or lordosis, of the lumbar spine should be completely eliminated or minimized. A patient with degenerative disc disease may have a more pronounced lordosis, making it more difficult to place a needle between the vertebral bodies. To effectively place a needle into the lumbar spine, the patient should be comfortable, still, and lie in a plane as parallel to the top of the operating table as possible, and the lordosis of the lumbar spine should be reduced as much as possible.

For a cervical puncture, the patient's neck should be convexly flexed to the maximum degree. The cervical spine naturally has a slight S-shaped curve, but is almost straight if a muscular spasm is present. It is extremely difficult to place a needle between the cervical vertebrae without a great deal of cervical flexion.

For punctures at the spine's thoracic region, which is naturally curved posteriorly, increased cervical spine flexion and decreased lumbar spine lordosis may not be as critical to the success of the procedure as in cervical and lumbar spine punctures, respectively. However, the patient is likely to be more comfortable and therefore cooperative during thoracic spine punctures if the cervical spine is flexed and the lumbar lordosis is decreased. To place a needle into the thoracic epidural space, the patient should be still, comfortable, and lie in a plane parallel to the top of the operating room table. The needle is generally inserted at a largely oblique angle to the spine in order to pass between the spinous processes of the thoracic vertebrae.

Presently, a patient receiving a lumbar or cervical epidural or intrathecal injection is typically placed in a prone position on one or two standard pillows or other dome-shaped devices under either the abdomen or the chest. The pillow is usually not sufficiently dense to eliminate the lordosis of the spine. Also, a patient with a large protruding belly tends to tilt to the right or the left when using pillows. Pillows may also provide a very clumsy and uncomfortable means of positioning a patient for a cervical injection. Pillows positioned this way may be particularly uncomfortable for patients with large chests or breasts. Unfortunately, uncomfortable patients are more likely to move during the course of the therapeutic or diagnostic procedure, making it both more difficult for the physician and more dangerous to the patient.

Other devices in the prior art are believed to be encumbered with various disadvantages. One typical prone frame, often used to perform spinal surgery, is the Wilson Spinal Surgery Frame, described in and shown in FIGS. 1–4 of U.S.

Pat. No. 5,584,302 to Sillaway, et al., which issued Dec. 17, 1996, which is herein incorporated by reference. The Wilson frame has two elongated, parallel panels separated by a gap and attached to a metallic frame base. After a patient lies lengthwise in a prone position over the panels, a crank is used to bow the parallel panels into a convex shape. While the Wilson frame facilitates spinal surgery, it does little to eliminate lumbar lordosis. Therefore, the frame can be uncomfortable and may be impractical for an outpatient setting.

Other prone support devices, such as those described in U.S. Pat. No. 5,613,254 to Clayman, U.S. Pat. No. 5,239,716 to Fisk, U.S. Pat. No. 5,131,106 to Jackson, U.S. Pat. No. 5,014,375 to Coonrad et al., U.S. Pat. No. 4,840,362 to Bremer, et al., and U.S. Pat. No. 4,398,707 to Cloward, include multiple pieces or moving parts which complicate the setup and operation of the frame. These frames take excessive time to operate in a busy outpatient setting. None of these frames are believed to be suitable for a cervical injection.

Other frames used by spinal surgeons and pain specialists are comprised of a plastic frame covered with a layer of gel. These frames are very hard and may interfere with breathing in a large or obese patient. Moreover, a patient will typically lie on such a frame for about 15 minutes—that is, after the doctor has already commenced the procedure—before beginning to complain of discomfort. These frames also typically lack any feature to reduce lumbar lordosis or maximize cervical flexion.

There is accordingly a need for an improved support system.

SUMMARY OF THE INVENTION

To this end, a foam support device is provided that supports and elevates the torso of a patient in a prone (face-down) position, resists lateral movement or lateral rotation of the patient, and provides an elongated cushion extending laterally for additional elevation of the pelvis, or alternatively, of the chest, of the patient.

One object of the present invention is to provide a support system that aids a practitioner in performing spinal taps and punctures.

Another object of the present invention is to provide a support system which can hold a person in a prone position while minimizing the lumbar lordosis of the spinal column.

Still another object of the present invention is to provide a method of minimizing or eliminating the lumbar lordosis of the spinal column while holding a person in a prone position.

Another object of the present invention is to provide a support system which can maximize cervical flexion of the spinal column while holding the person in a prone position.

Still another object of the present invention is to provide a method of maximizing cervical flexion of the spinal column while holding a person in a prone position.

A further object of the present invention is to provide a support system that resists lateral movement or lateral rotation of a person while holding that person in a prone position.

A more particular object of the present invention is to provide a support system that facilitates an injection into the cervical region of the spinal cord of a person lying in a prone position.

Another more particular object of the present invention is to provide a support system that facilitates an injection into the lumbar region of the spinal cord of a person lying in a prone position.

A further object of the present invention is to provide a disposable device for supporting patients receiving injections into the intrathecal or epidural space.

Still other objects of the present invention are to provide a medical device to support a person receiving a spinal tap or puncture that is simple in construction, economic to produce, easy to use, safe, and comfortable to the patient.

In satisfaction of these and other objects, the present invention provides an integrated, substantially rectangular device of resilient material such as high-quality foam having a substantially planar bottom surface for placement on a standard table, such as a clinical or operating room table, a substantially V-shaped, synclinal upper surface for supporting the torso of the patient and resisting lateral movement or rotation thereof, and a hemicylindrical raised portion at one end of the device for elevating the pelvis or, alternatively, the neck and chest of the patient.

To use the present invention to facilitate a lumbar injection, a patient reposes his or her chest in the V-shaped indentation of the upper surface of the device and his or her pelvis over the device's hemicylindrical raised portion. In this position, the patient's pelvis is suspended between the raised portion and the patient's knees, and the patient's head hangs over the end opposite the raised portion. The V-shaped indentation holds the patient's torso in a plane parallel to the top of the clinical or operating room table and resists any lateral rotation thereof to the right or the left. The raised portion acts as an axis about which the patient's pelvis is rotated convexly, thus reducing the lordosis of the lumbar spine.

To use the present invention to facilitate a cervical injection, the device is rotated by 180 degrees so that the patient's chest is supported by the raised portion and the lower part of the patient's torso is supported by the V-shaped indentation. In this position, the V-shaped indentation holds the patient's torso parallel to the top of the operating room table and resists any lateral rotation thereof to the right or the left. Also, the patient's chest is supported by the raised portion, so that the head hangs down over the end of the device that includes the raised portion, thereby maximizing cervical flexion.

The present invention has many advantages. It is lightweight. Because the device is inexpensive to produce, it can be used disposably. Because the device has no moving or adjustable parts, minimal training is necessary to learn how to correctly use it. Likewise, only a few seconds are required to correctly place it on a clinical table or operating table. Also, the device's configuration provides optimal comfort to patients receiving either lumbar or cervical injections. Additionally, the device's configuration helps patients to repose naturally into the correct position, because it corresponds to a position of maximum comfort. Moreover, the device is versatile because it is configured for either lumbar or cervical injections.

In one embodiment, the invention consists of a single unitary piece. In another embodiment, it is comprised of, and easily assembled from, multiple pieces.

BRIEF DESCRIPTIONS OF THE DRAWINGS

The present invention is more easily understood with reference to the drawings, in which.

Figure 13:
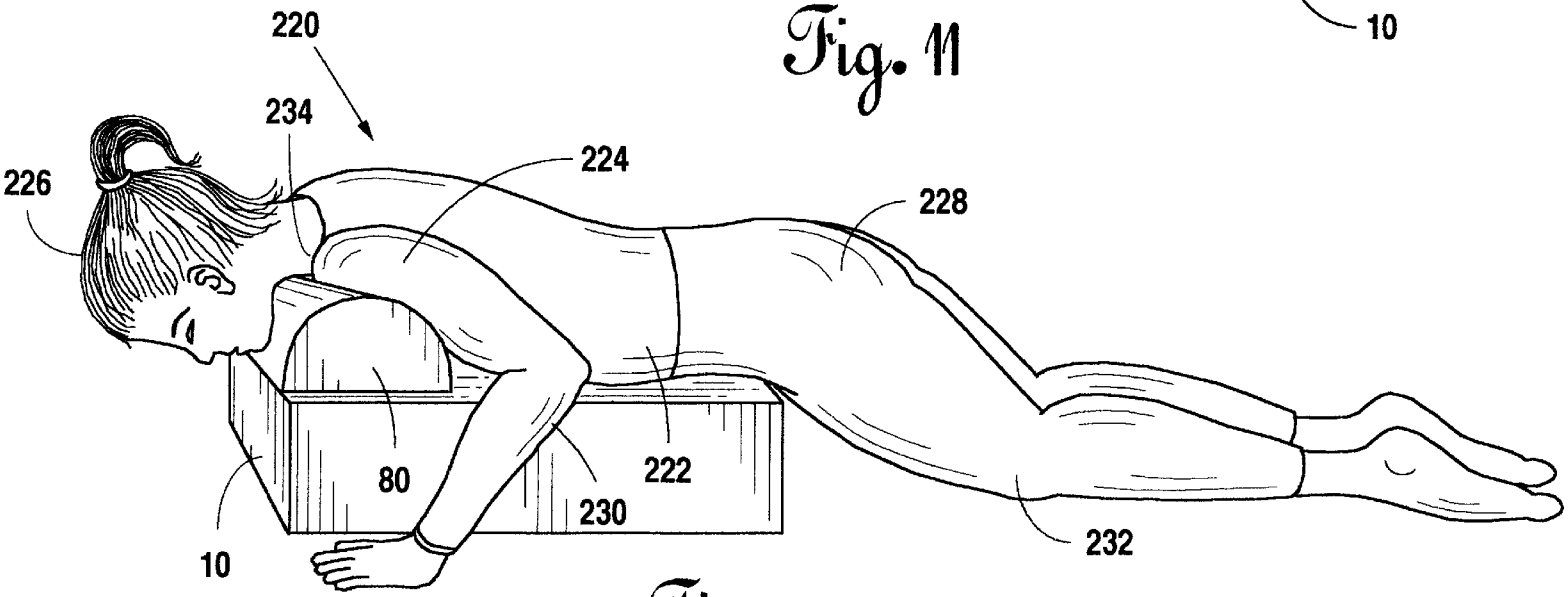

FIG. 13 demonstrates a female figure lying on the prone frame with the neck flexed. This position is considered suitable for a cervical injection.

DETAILED DESCRIPTIONS OF THE PREFERRED EMBODIMENTS

Referring in more detail to the drawings, there is shown in FIGS. 1–4 one embodiment of the prone frame 10 of the present invention. Prone frame 10 is shown with an upper surface 12 having a lengthwise recess terminating at a trough intersection 30 and a raised rounded portion 80 extending laterally along one end of the frame 10. Although the particular contour of upper surface 12 can be varied, it preferably has a generally V-shaped cross section formed by two symmetric, substantially planar, rectangular regions inclined down from opposite directions (i.e., synclinal) designated as left portion 24 and right portion 26 that intersect at trough intersection 30. This frame is relatively simple and inexpensive to manufacture and is adapted for generally receiving and supporting the torso of a patient in a prone position while resisting lateral side-to-side movement or rotation of the patient.

Other details shown include a vertical anterior surface 70, a vertical right side surface 64, a vertical left side surface 66, a posterior surface 62, and a bottom surface 14. Bottom surface 14 is preferably substantially planar and is adapted for being placed on a table such as typically found in a clinical setting and intended to receive or support a patient during an examination or procedure. Surface 62 preferably is substantially orthogonal to bottom surface 14 where the two surfaces join but curves cylindrically and convexly about a lateral axis 18 of frame 10 until it converges with upper surface 12, thereby defining a generally hemicylindrical shape for the raised portion 80, which is adapted for raising the pelvis or chest of a patient.

Figure 1:
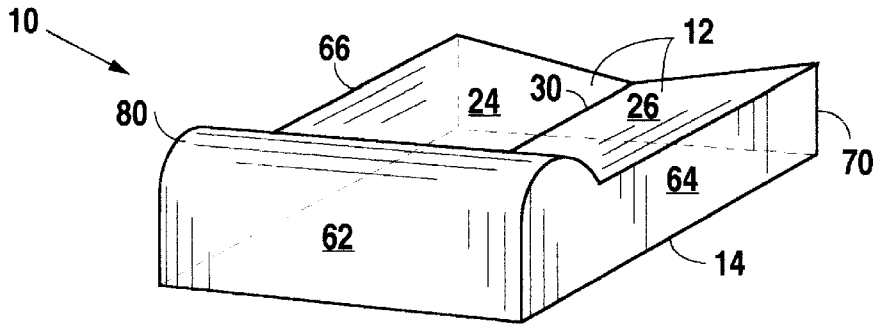
FIG. 1 is a perspective view showing the prone frame as one unitary piece.
Figure 3:
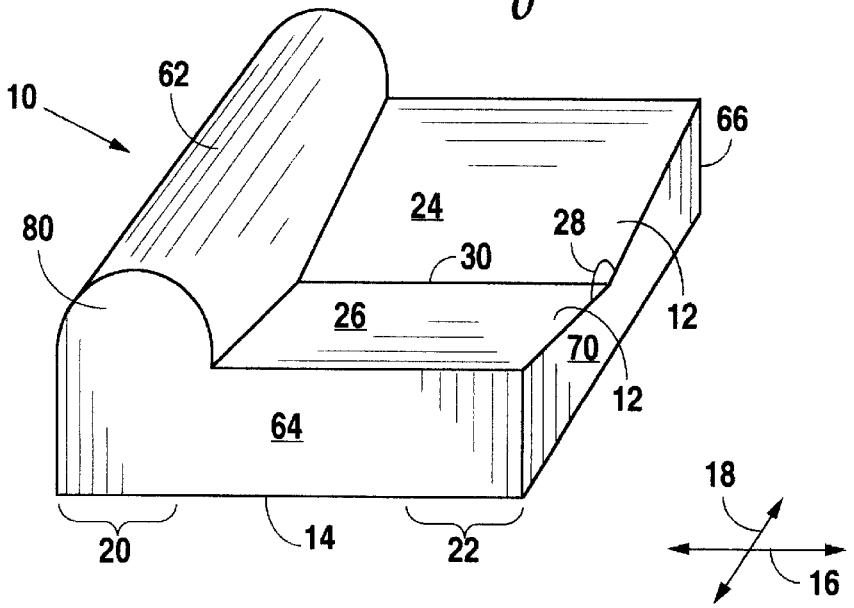
FIG. 3 is another perspective view of the prone frame of FIG. 1 from a different angle.
Figure 4:
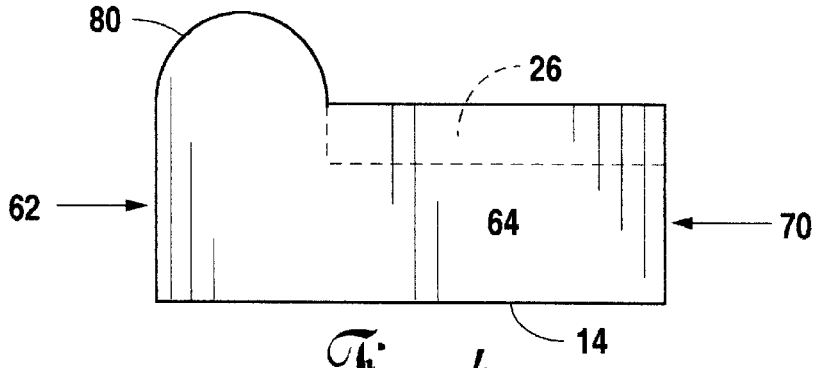
FIG. 4 is a side view of the prone frame of FIG. 3.

Referring now to FIGS. 3 and 4, raised portion 80 preferably extends along a rear end 20 of the prone frame 10 along a substantial portion of a latitudinal axis 18 thereof. Upper surface 12 is preferably recessed about and extends along and parallel to a substantial portion of the frame's longitudinal axis 16. Left and right support surface portions 24 and 26 preferably converge along the trough intersection 30 forming the generally V-shaped, synclinal contour of upper support surface 12. Support portions 24 and 26 preferably have roughly equal surface areas, and are preferably sloped at equal and opposite angles with respect to the bottom surface 14 (FIG. 1). Trough intersection 30 preferably extends along a substantial portion of the frame's longitudinal axis 16—from the front 22 to the raised hemicylindrical portion 80 at the rear end 20 of frame 10—above and substantially parallel to the bottom surface 14 (FIG. 1). Also, the convergence of right and left portions 24 and 26 form a dihedral angle 28 that is preferably obtuse, that is, between 90 and 180 degrees.

Figure 2:
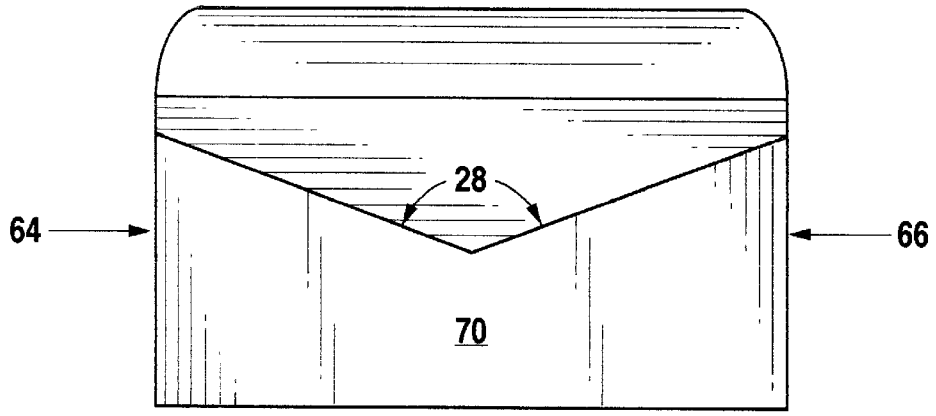
FIG. 2 is an end view of the prone frame of FIG. 1.

The symmetrical V-shaped recess in upper surface 12 functions to support a patient's pelvis or chest in a position substantially parallel to a table surface on which the frame 10 may be placed and resists lateral, side-to-side movement or lateral rotation of a patient reposed therein. Although FIGS. 1–2 depict upper surface 12 as having two substantially planar sloped surface portions, upper surface 12 could alternatively have a more rounded, concave contour. Upper surface 12 may also be convoluted or punctuated with dimples, egg-crate-shaped valleys and ridges, or other pressure-dispersion cuts, to provide a patient reposing on prone frame 10 with optimal comfort.

Figure 5:
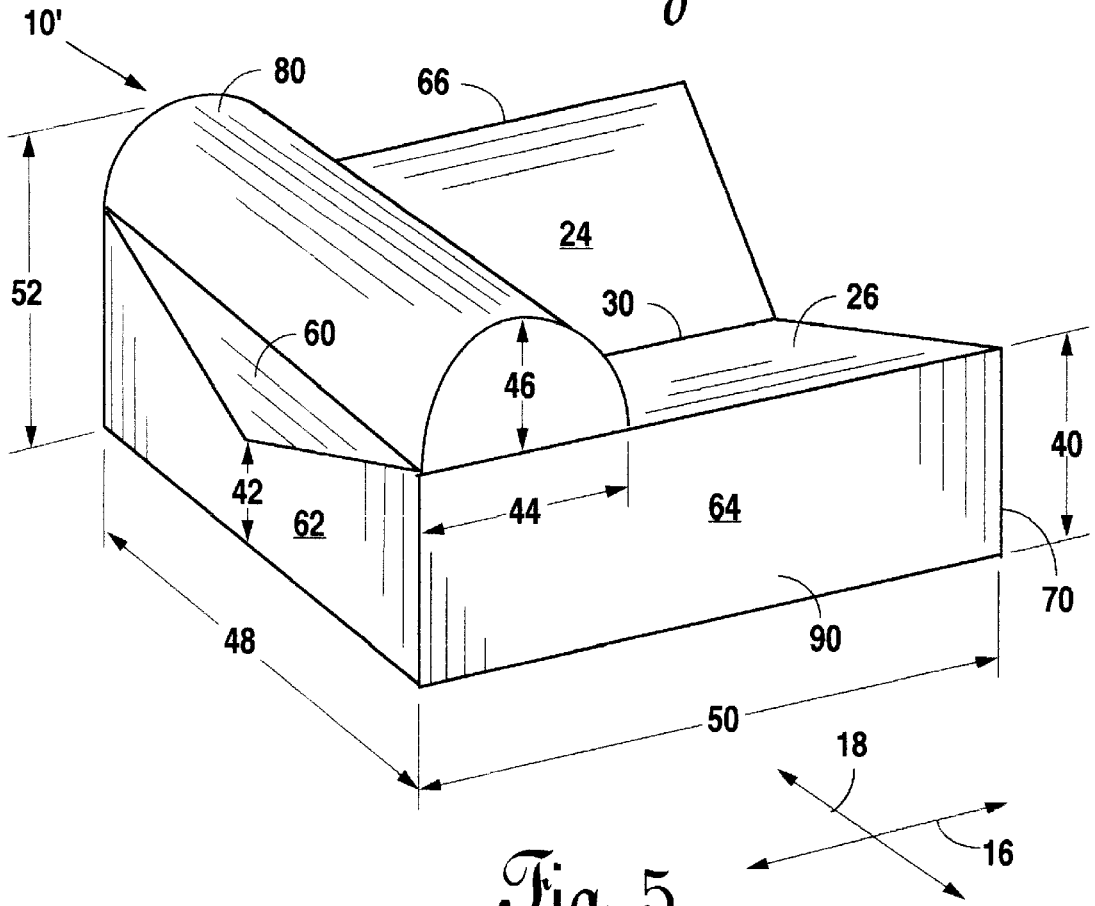
FIG. 5 is a perspective view showing the prone frame as an integration of multiple pieces.

FIGS. 1–4 depict prone frame 10 as a single unitary piece. Prone frame 10 may alternatively be an integral unit of multiple pieces, as shown in FIG. 5. FIG. 5 depicts 3-piece prone frame 10' as including a first upper hemicylindrical raised portion 80 disposed upon a second inverted triangular wedge portion 60, which is in turn disposed on a third heptahedral portion 90. Portion 90 itself may be comprised of two or more pieces. Although comprising 3 or more pieces, prone frame 10' shown in FIG. 5 is the identical shape of prone frame 10 of FIGS. 1–4.

FIG. 5 shows the dimensions 40, 42, 44, 46, 48, 50, and 52 of prone frame 10'. The dimensions of FIG. 3 are drawn generally, but not necessarily exactly, to scale. Although the features of the present invention are not strictly limited to any set of dimensions, prone frame 10' may have a length 50 of between 6 and 24 inches, preferably about 18 inches, which approximates the distance between the hip and shoulders of an average adult human being, a width 48 of between 6 and 36 inches, preferably about 24 inches, which is the width of most operating room tables, an edge height 40 of between 4 and 18 inches, preferably about eight and three-quarter inches, a trough-line height 42 of between 2 and 12 inches, preferably about five inches, a cylindrical width 44 of between 3 and 12 inches, preferably about eight inches, and a hemicylindrical height 46 of between 1½ and 6 inches, preferably about four inches. With the preferable dimensions, the integral height 52 of prone frame 10' from the base 14 to the top of the hemicylindrical portion 80 is about twelve-and-three-quarter inches, a height significant enough to support a patient off of a table on which the prone frame 10 might be placed.

These suggested dimensions are suitable for either of the preferred embodiments of FIGS. 1–4 or FIG. 5. The preferred dimensions are suitable for the support of a patient with a height of between about 4 feet, 10 inches, and about six feet, two inches, and weighing between about 110 pounds and about 200 pounds. These dimensions, of course, are relative and may be subject to change depending on the size and proportions of the patient.

Figure 6:
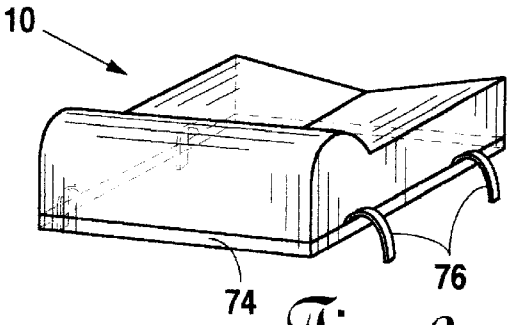
FIG. 6 is a perspective view of another embodiment of the prone frame attached to a rigid board and including straps.

FIG. 6 shows an alternative embodiment in which the prone frame 10 is connected to a board 74 having tie fasteners 76, which may be straps, for mounting to the top surface 84 (FIG. 5) of a table 82 typically found in a clinical setting and intended to receive or support a patient during an examination or procedure. Board 74 may be formed of any suitable rigid material, but is preferably formed of an inexpensive disposable material such as cardboard or plastic. Board 74 is connected to the bottom surface 14 (FIG. 1) of frame 10 using an adhesive or other connector as would be understood by those of ordinary skill in the art. Of course, prone frame 10 could have tie fasteners 76 without a board 74.

Figure 7:
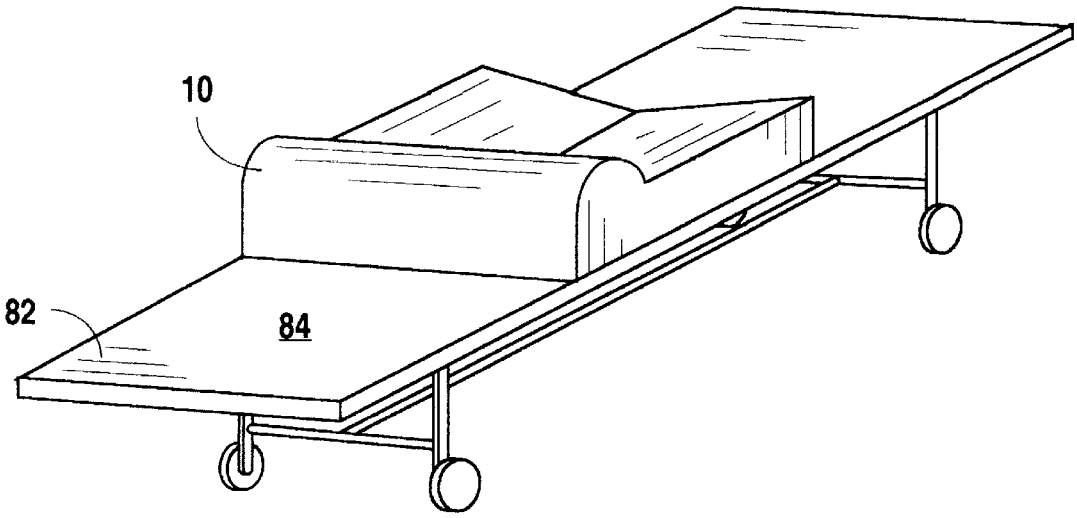
FIG. 7 is a perspective view of the prone frame placed on a table such as typically found in a clinical setting and intended to receive or support a patient during an examination or procedure.

FIG. 7 shows prone frame 10 placed on a patient support table 82. Of course, prone frame 10 can be placed on any suitable support surface.

Figure 8:
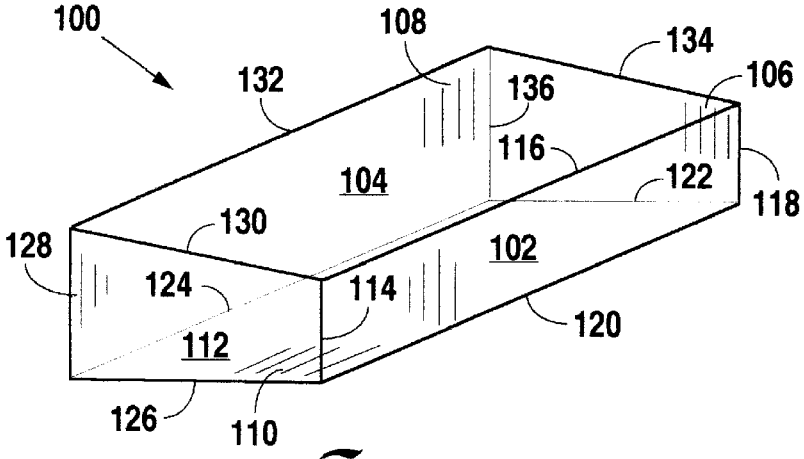
FIG. 8 is a perspective view of one of the pieces that may be used to assemble the prone frame.
Figure 9:
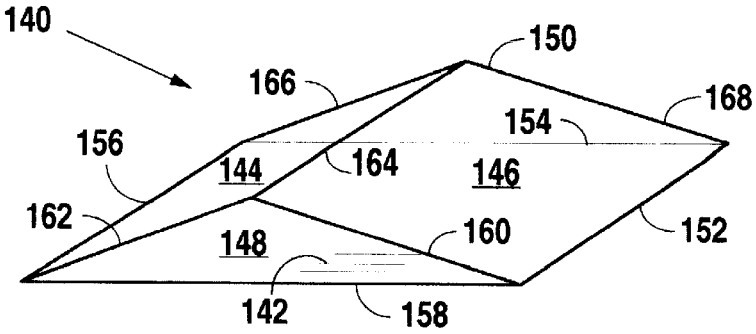
FIG. 9 is a perspective view of another piece that may be used in an assembly of the prone frame.
Figure 10:
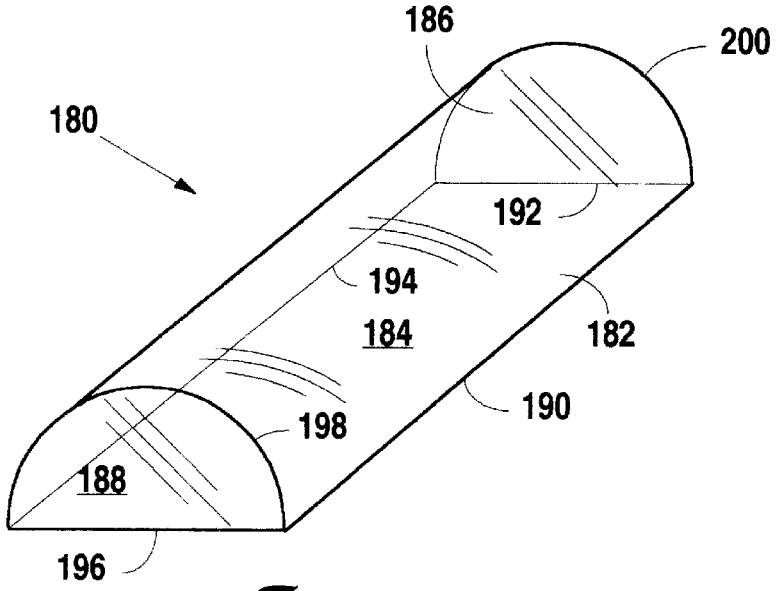
FIG. 10 is a perspective view of yet another piece that may be used in an assembly of the prone frame.

As discussed earlier, prone frame 10 may be manufactured as a single unitary piece or alternatively integrated from smaller pieces. FIGS. 8–10 depict a trapezoidal piece 100, a triangular piece 140, and a hemicylindrical piece 180, one or more of each of which can be used in the assembly of prone frame 10.

In accordance with FIG. 8, trapezoidal piece 100 preferably has a hexahedral shape with four rectangular faces 102, 104, 108, and 110, two congruent trapezoidal faces 106 and 112, and twelve edges 114, 116, 118, 120, 122, 124, 126, 128, 130, 132, 134, and 136. Face 102 preferably shares vertical edge 114 with face 112, longitudinal edge 116 with face 104, vertical edge 118 with face 106, and longitudinal edge 120 with face 110. Face 110 preferably shares latitudinal edge 122 with face 106, longitudinal edge 124 with face 108, and latitudinal edge 126 with face 112. Face 112 preferably shares vertical edge 128 with face 108 and slanted edge 130 with face 104. Face 104 preferably shares longitudinal edge 132 with face 108 and slanted edge 134 with face 106. Face 106 preferably shares vertical edge 136 with face 108.

In accordance with FIG. 9, triangular piece 140 preferably has a pentahedral shape with three rectangular faces 142, 144, and 146, two congruent triangular faces 148 and 150, and nine edges 152, 154, 156, 158, 160, 162, 164, 166, and 168. Face 142 preferably shares longitudinal edge 152 with face 146, latitudinal edge 154 with face 150, longitudinal edge 156 with face 144, and latitudinal edge 158 with face 148. Face 148 preferably shares slanted edge 160 with face 146 and slanted edge 162 with face 144. Face 144 preferably shares longitudinal edge 164 with face 146 and slanted edge 166 with face 150. Face 150 shares slanted edge 168 with face 146.

In accordance with FIG. 10, hemicylindrical piece 180 preferably has a shape of a cylinder cut in half along the length and diameter of the cylinder. Hemicylindrical piece 180 preferably has a rectangular face 182, a curved upper face 184, two congruent semicircle faces 186 and 188, four linear edges 190, 192, 194, and 196, and two curved edges 198 and 200. Face 182 preferably shares parallel, opposing, latitudinal edges 190 and 194 with face 184. Face 188 preferably shares longitudinal edge 196 with face 182 and curved edge 198 with face 184. Face 186 preferably shares longitudinal edge 192 with face 182 and curved edge 200 with face 184.

Prone frame 10 may be assembled by obtaining two substantially identical trapezoidal pieces 100, one triangular piece 140, and one hemicylindrical piece 180. Pieces should be obtained wherein face 142 of triangular piece 140 is congruent with face 182 of hemicylindrical piece 180. Also, edges 154 and 158 of triangular piece 140 and edges 190 and 194 of hemicylindrical piece 180 should have lengths that are equal to each other and double the lengths of edges 122 and 126 of trapezoidal pieces 100. Furthermore, edges 160, 162, 166, and 168 of triangular piece 140 and edges 130 and 134 of trapezoidal pieces 100 should all have equal lengths.

To put the pieces together, the two substantially identical trapezoidal pieces 100 are preferably facially mated together at face 102. In this way, the bottom rectangular face 110 of one of the trapezoidal pieces 100 are coplanar with the corresponding face 110 of the other, forming the frame's bottom surface 14. Also, the two trapezoidal pieces' top sloping rectangular faces 104 form the right and left portions 24 and 26 of the frame's V-shaped upper surface 12.

Next, the triangular piece 140 is preferably attached to the frame's upper surface 12 so that faces 144 and 146 facially mate with the top sloping rectangular faces 104 of the two conjoined trapezoidal pieces at a proximate end thereof. Triangular piece 140 is preferably attached at the rear end 20 of the upper surface 12 so that face 148 is integral with the frame's posterior surface 62.

Next, the rectangular face 182 of a hemicylindrical piece 180 is preferably facially mated to the corresponding rectangular face 142 of triangular piece 140, so that face 184 is integral with the frame's posterior surface 62.

The trapezoidal, triangular, and hemicylindrical pieces may be facially mated with each other using, for example, an application of an adhesive with high contact strength, such as 3M HI-STRENGTH 90 SPRAY glue. Other methods of connection are evident to one of ordinary skill in the art.

When assembled, all of the longitudinal edges of pieces 100, 140, and 180 should be parallel to the frame's longitudinal axis 16. Likewise, all of the latitudinal edges thereof should be parallel to the frame's latitudinal axis 18. Furthermore, all of the vertical edges thereof should be perpendicular to the frame's latitudinal and longitudinal axes 16 and 18.

The features of the invention are not, of course, limited to an assembly of pieces having the particular configurations of FIGS. 6–8. For example, a rectangular piece and two triangular pieces could be substituted for the two trapezoidal pieces 100. Alternatively, each trapezoidal piece 100 could be comprised of two smaller triangular pieces or a triangular piece and a rectangular piece. These and other configurations would have the advantages of being easy to manufacture and assemble.

For all of the preferred embodiments, prone frame 10 is preferably a cushion or pad comprised of a resilient material such as foam, but could alternatively be comprised of one or more membranes that are filled with air or gel. Prone frame 10 is more preferably comprised of one or more pieces of solid foam designed for medical use and meeting the fire resistance safety standards of California Tech Bulletin 117, UL94HBF, and National Bureau of Standards FT4-72, standards familiar to those skilled in the art. Prone frame 10 may, of course, be comprised of several different pieces or layers of varying types of resilient material or foam.

Prone frame 10 is preferably comprised of foam having a density of at least 1.4 to 1.8 pounds per cubic foot, being capable of resiliently supporting and elevating a 200-pound patient sufficiently to minimize lumbar lordosis or improve cervical flexion. Using foam of this density, a prone frame 10 in accordance with the preferred dimensions of FIG. 3 should weigh less than five pounds.

Figure 11:
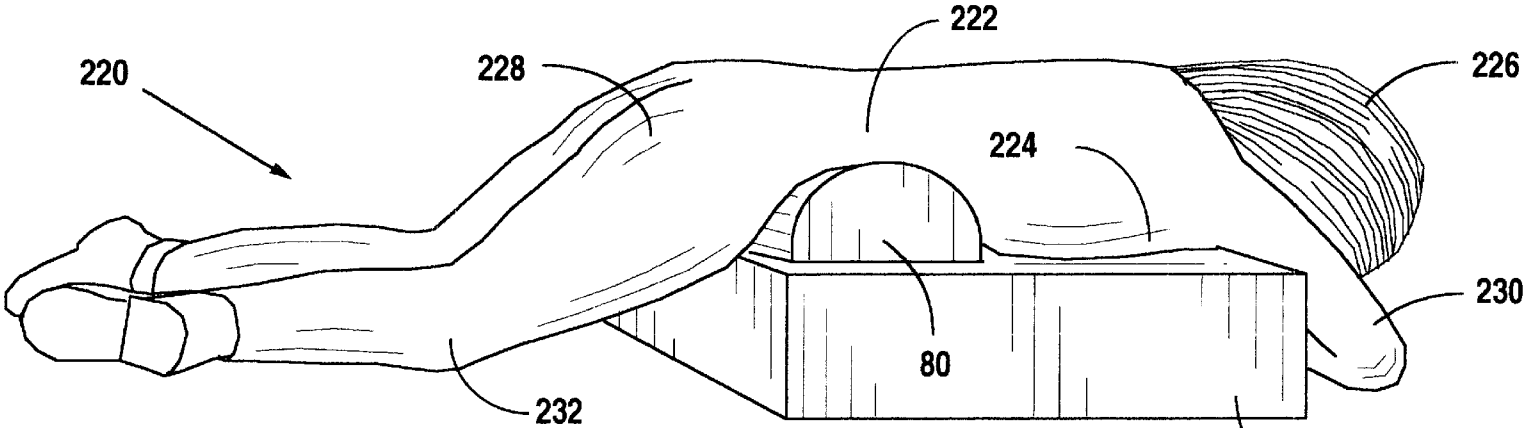
FIG. 11 shows a female figure reclining in a prone position, demonstrating the absence of lordosis in the lumbar spine. The figure has her pelvis lying on the prone frame, which rotates the pelvis to eliminate lumbar lordosis.

FIG. 11 demonstrates the use of prone frame 10 to reduce or eliminate lumbar lordosis. A female patient 220 is shown reposing along the longitudinal axis 16 (FIG. 3) of the frame 10, with the raised hemicylindrical portion 80 supporting her pelvis 222 and the frame's recessed upper surface 12 (FIG. 3) supporting her chest 224. The comfortable V-shaped contour of the upper surface 12 resiliently supports her whole torso in a substantially horizontal plane while resisting any lateral rotation or movement of the patient. The patient's head 226 hangs over the frame's front end 22 (FIG. 3), supported by her arms 230 in a crossed position. The patient's pelvis 228 is suspended above the clinical table surface 84 (FIG. 7), between her pelvis 222 and her knees 232, which rest upon the table surface 84. The upward pressure on the patient's pelvis 222 exerted by the resilient foam in the raised cylindrical portion 80, in conjunction with the pull of gravity on her pelvis 228, creates a torque which rotates her pelvis toward the table surface 84, thereby reducing or eliminating the lordosis of her lumbar spine. With this arrangement, the patient's comfort and care are improved, facilitating diagnostic or therapeutic procedures for the spine which may take anywhere from several minutes to several hours.

Figure 12:
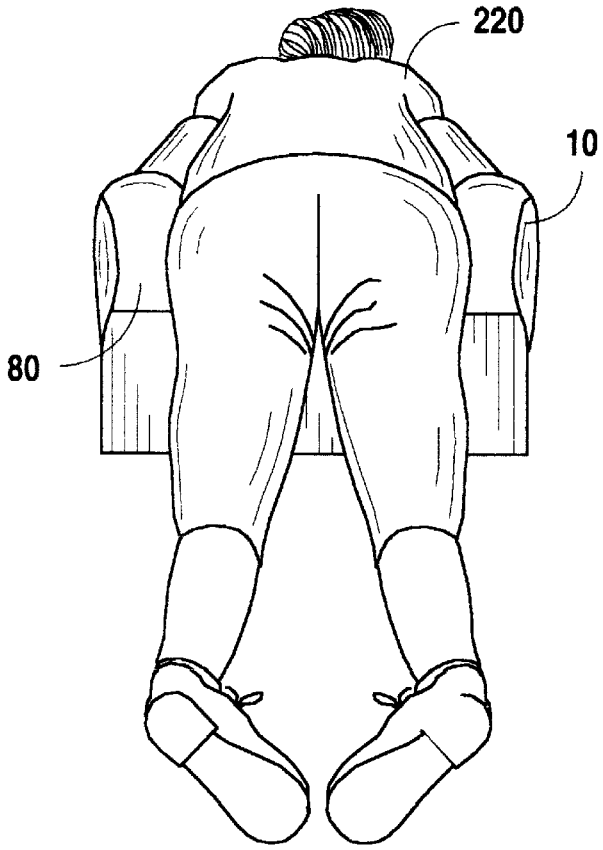
FIG. 12 shows a caudal view of a figure lying on the prone frame to reduce lumbar lordosis.

FIG. 12 provides a caudal view of a patient 220 using frame 10 to reduce lumbar lordosis. FIG. 12 shows the compression of the frame 10, particularly of the hemicylindrical portion 80, caused by the weight of the patient 220, and the resulting cushioning that frame 10 provides to the patient's torso.

FIG. 13 demonstrates the use of prone frame 10 to maximize cervical flexion. Here, the prone frame 10 is rotated 180 degrees from the configuration shown in FIG. 11 Female patient 220 is shown reposing along the longitudinal axis 16 (FIG. 3) of the frame 10, with the raised hemicylindrical portion 80 supporting her chest 224 and neck 234 and the frame's recessed upper surface 12 (FIG. 3) supporting her pelvis 222. The comfortable synclinal contour of the upper surface 12 resiliently supports her whole torso in a substantially horizontal plane while resisting any lateral rotation or movement of the patient. The patient's head 226 hangs over frame's back end 20 (FIG. 3), and her arms 230 hang over the frame's sides 64 and 66. The patient's pelvis 228 is suspended above the clinical table surface 84 (FIG. 7), but not as much as shown in the configuration of FIG. 11. The upward pressure on the patient's chest 222 and neck 234 exerted by the resilient foam in the raised cylindrical portion 80, in conjunction with the pull of gravity on her head 226, creates a torque which rotates her head toward the table surface 84, thereby maximizing the flexion of her cervical spine. The use of the frame 10 in this manner facilitates easy visualization and penetration of the intervertebral spaces and paraspinal muscles of the neck.

Prone frame 10 is an integral, lightweight, relatively small support device, which is both cost effective and designed to be used in many types of procedures requiring the patient to be in a prone position.

As already noted, prone frame 10 can be used for both cervical and lumbar epidural injections. In addition, frame 10 can be used for any procedure that requires a patient to be in the prone position with minimum lordosis of the lumbar spine. Such procedures include lumbar sympathetic block injections, fluoroscopy, facet injections, discograms, intradiscal electrothermal therapy, occipital nerve block injections, trigger point injections, nerve root block injections, epiduroscopy and any type of radiofrequency lesioning.

Frame 10 also facilitates placement of spinal cord stimulating electrodes, which are inserted with needles into the epidural space of the spinal column to alleviate severe low back or neck pain. For this procedure, reducing the lordosis of the spine is particularly valuable. Typically, a patient is merely sedated, rather than put under general anesthesia, for the majority of such a procedure. Because such a patient is typically aware of his or her surroundings, he or she will tend to move if in an uncomfortable position. Therefore, it is particularly important to make the procedure comfortable to the patient.

Prone frame 10 can also be used in many types of spinal surgeries, such as laminectomies and discectomies where the patient is under general anesthesia. Because there are no metallic parts in frame 10, there is minimal chance of bodily injury from pressure points developing during prolonged surgery.

While the present invention has been described in terms of preferred embodiments, it is apparent that one skilled in the art could practice numerous alternative embodiments while remaining within the spirit and scope of the present invention. Accordingly, the scope of the invention is to be limited only by the following claims and their equivalents.

What is claimed is:

1. A cushion support for supporting a patient in a generally prone position comprising a raised upper support surface having a lengthwise recess and a raised support portion extending laterally along one end of the cushion support for comfortably supporting a patient for treatment by positioning and maintaining a patient's spine in an optimal position, said cushion support further including a bottom surface adapted to conform generally to an upper surface of a patient support table, wherein the lengthwise recess has a generally V-shaped cross section;

the upper surface is adapted to generally support a patient's torso, and wherein the raised portion has a generally hemicylindrical shape adapted to raise a patient's pelvis; and the cushion further includes a board attached to the bottom surface of the cushion, said board having fasteners for securing the cushion to an operating room table.

2. The cushion support of claim 1, wherein the cushion has a width of about 24 inches and a length of about 18 inches.

3. The cushion support of claim 1, wherein the cushion has a weight of less than five pounds.

4. The cushion support of claim 1, wherein the raised portion has a generally hemicylindrical shape.

5. The cushion support of claim 1, wherein the cushion is formed of a resilient material selected from the group consisting of foam, an air-filled membrane, and a gel-filled membrane.

6. The cushion support of claim 1, wherein the cushion is formed of resilient foam having a density of at least about 1.4 pounds per cubic foot and no more than about 1.8 pounds per cubic foot.

7. The cushion support of claim 1, wherein the board is formed of a material selected from the group consisting of cardboard and plastic.

8. An apparatus for supporting a surgical patient, comprising:

a first base block having a bottom face, a first trapezoidal end face, a second trapezoidal end face, a sloped top face including a distal end and a proximate end, an outer side face, and an inner side face;

a second base block having a bottom face, a first trapezoidal end face, a second trapezoidal end face, a sloped top face including a distal end and a proximate end, an outer side face, and an inner side face;

a generally triangular third block having a first rectangular sloped face, a second rectangular sloped face, a rectangular top face, a first triangular end face, and a second triangular end face;

an elongated fourth block having a rounded top face, a rectangular bottom face, a first semicircular end face, and a second semicircular end face;

wherein the inner side face of the first base block is facially mated to and contiguous with the inner side face of the second base block;

wherein the first slanted face of the third block is facially mated to the proximate end of the sloped top face of the first block;

wherein the second slanted face of the third block is facially mated to the proximate end of the top face of the second block;

wherein the bottom face of the fourth block is facially mated to and contiguous with the top face of the third block; and wherein the distal end of the first block's top face and the distal end of the second block's top face define a upper surface with a V-shaped cross section adapted for supporting a patient in a generally prone position and resisting lateral movement of the patient.

9. The apparatus of claim 8, wherein the rounded top face of the fourth block is adapted for resiliently supporting the pelvis of a patient who is received in a generally prone position on the apparatus's upper surface, thereby reducing lumbar lordosis in the patient's spinal column.

10. The apparatus of claim 8, wherein the rounded top face of the fourth block is adapted for resiliently supporting the chest of a patient who is received in a generally prone position on the apparatus's upper surface, thereby flexing the cervical region of the patient's spinal column in a convex direction.

* * * * *